US009168987B1

(12) United States Patent
Sharapov

(10) Patent No.: US 9,168,987 B1
(45) Date of Patent: Oct. 27, 2015

(54) GEOGRAPHICALLY STABLE FLOATING PLATFORM STRUCTURE

(71) Applicant: Sergey Sharapov, San Francisco, CA (US)

(72) Inventor: Sergey Sharapov, San Francisco, CA (US)

( * ) Notice: Subject to any disclaimer, the term of this patent is extended or adjusted under 35 U.S.C. 154(b) by 0 days.

(21) Appl. No.: 14/156,735

(22) Filed: Jan. 16, 2014

(51) Int. Cl.
*B63B 35/44* (2006.01)
*B63B 38/00* (2006.01)

(52) U.S. Cl.
CPC ..... *B63B 38/00* (2013.01); *B63B 35/44* (2013.01)

(58) Field of Classification Search
CPC ..... B63B 35/44; B63B 21/50; B63B 21/48; B63H 25/00; B63H 25/44
USPC ..... 114/264, 265, 266, 267; 405/200, 405/223.1, 224
See application file for complete search history.

(56) References Cited

U.S. PATENT DOCUMENTS

| | | | | |
|---|---|---|---|---|
| 3,986,471 | A * | 10/1976 | Haselton | 114/265 |
| 4,834,014 | A | 5/1989 | Olsen et al. | |
| 4,938,630 | A * | 7/1990 | Karsan et al. | 405/224 |
| 4,986,121 | A | 1/1991 | Luscombe | |
| 5,375,550 | A | 12/1994 | Innis | |
| 6,694,910 | B1 | 2/2004 | Sharapov | |
| 7,575,397 | B2 | 8/2009 | Sharapov | |
| 7,708,497 | B2 | 5/2010 | Wilcox | |
| 7,823,525 | B2 | 11/2010 | Brown et al. | |
| 7,934,462 | B2 * | 5/2011 | Mansour et al. | 114/264 |

FOREIGN PATENT DOCUMENTS

| | | |
|---|---|---|
| DE | 3336352 | 4/1985 |
| SU | 1113303 | 9/1984 |

OTHER PUBLICATIONS

N. K. Haichenko, *Sistema Ekvatorialnikh Protivotechenil* v *Okeane*[The Oceanic System of Equatorial Countercurrents], pub. Gidrometeoizdat, Leningrad, 1974, 158 p.
V. A. Burkov, Obshchaya Tsirkulyatsiya Mirovogo Okearia [General Circulation in the World Ocean], pub. Gidrometeoizdat, Leningrad, 1980, 156 p.
Mostafa Shahrabi and Khosrow Bargi in Frontiers of Structural and Civil Engineering, Sep. 2013, vol. 7, Issue 3. pp. 325-331 under the title "Numerical simulation of mu".
Wayne Gramlich in 1999 on Seasteading—Homesteading the High Sea (http://gramlich.net/projects/oceania/seastead2/#Gramlich1999 and the SeaSteading Institute Book of 2010 (h.
"Floating Ocean Platforms" by Dr. Ronald N. Kostroff, Office of Naval Research, 800 N Quincy St., Arlington, VA 22217; Internet: kostofr@onr.navy.mil).
Alexander Bolonkin, C&R, 1310 Avenue R, No. F-6, Brooklyn, NY 11229, USA; T/F 718-339-4563,aBolonkin@juno.com, http://Bolonkin.narod.ru).

* cited by examiner

*Primary Examiner* — Lars A Olson

(57) ABSTRACT

Proposed is a floating platform structure for use on the surface of the ocean in equatorial regions where a strong eastward Cromwell current exists below the westward surface current. In the present invention, the forces developed by these two opposite currents are used for maintaining the floating structure in a stable geographical position that may be important, e.g., for launching a satellite-carrying rocket. The structure contains a rigid three-dimensional frame, which is immersed to the depth of the Cromwell current and carries floating bodies that experience the effect of the Cromwell current for counterbalancing the dragging force applied to the structure in the opposite direction from the surface current. Vertical positions of the floating bodies are adjustable by a mechanism, the operation of which is controlled on the basis of signals obtained from GPS, which locates the geographical position of the floating structure.

21 Claims, 6 Drawing Sheets

GEOGRAPHICALLY STABLE FLOATING PLATFORM STRUCTURE

BACKGROUND OF THE INVENTION

1. Field of the Invention

The invention relates to floating objects, more specifically to a floating platform that floats on the surface of the ocean, in particular, in the area of the equator, and, specifically, in the area of the Cromwell equatorial current, which was discovered in the Pacific Ocean.

2. Description of the Prior Art

It is known that unique weather conditions characterize the equatorial section of the Pacific Ocean: the absence of storms, a significant prevalence of sunny days throughout the year, a constant wind direction, and a high background temperature. All of these factors are favorable to the construction of floating islands, on which people can work or take vacations.

In 1951, the Cromwell equatorial current was discovered in the Pacific Ocean. It measures up to 250 m in depth and stretches over more than 300 km across and about 800 km in length. Later, such equatorial currents with similar characteristics were discovered in the Atlantic Ocean and the Indian Ocean, i.e., the Lomonosov current in the Atlantic and the Tareev current in the Indian Ocean, respectively. These currents with similar characteristics have speeds up to 150 cm/s and are aligned along the equator but at an angle of 180° to the equatorial surface current (see N. K. Haichenko, Sistema Ekvatorialnikh Protivotechenii v Okeane [*The Oceanic System of Equatorial Countercurrents*], pub. Gidrometeoizdat, Leningrad, 1974, 158 p.; V. A. Burkov, Obshchaya Tsirkulyatsiya Mirovogo Okeana [*General Circulation in the World Ocean*], pub. Gidrometeoizdat, Leningrad, 1980, 156 p.). All of these currents are part of the world oceanic current system and have similar hydrodynamic characteristics.

A floating island is known to have been built in the form of a flower and to contain an independent power source to maintain life on the island (see British Patent GB, A, 2097340). However, this floating island is intended only for coastal use, to be deployed in calm, enclosed bays; it cannot be used in the open sea.

Another floating island is intended for seaside resorts and consists of foam plastic sheets linked together (see German Patent DE, A, 3336352). However, this island is difficult to control and can only drift along the surface current or be tugged by another vessel.

In addition, neither of the two above islands uses the energy of underwater currents for the purpose of movement. The most similar proposal to this idea is a drifting station for oceanographic research that consists of a buoy and a large container, as well as an underwater sail, which is connected to the buoy with a wire cable. A load is attached to the underwater sail, which has a fastening junction (See Russian Patent Publication SU, A, 1113303). The structure of the station described here ensures that it drifts with a velocity equal to that of the surface current, and does not allow for alteration of the direction of travel, for any movement against the current, or for maintaining a position at any given coordinate. The sail of this apparatus is intended to guarantee that the buoy drifts with a speed equal to that of the surrounding water, therefore reducing the magnitude of drift due to wind.

U.S. Pat. No. 6,694,910 issued on Feb. 24, 2004 to Sergey Sharapov discloses a floating island for enabling control of its movement or stability on the surface of the water, which flows in a given direction and in which the surface overlies an underwater current flow in another direction at an angle with respect to the given direction. The floating island comprises a main body having underwater and surface sections of positive buoyancy, an underwater sail having at least one side with a frontal area, and a system of cables that connect the sail with the underwater section. The cables position the sail so that the frontal area of its one side is at a lateral angle with respect to the given direction of the underwater current. The lateral angle is sufficient to cause the underwater current flow to impact against the frontal area with a force having a magnitude F that is transmitted from the sail through the system of cables to the floating island. The structure also has a mechanism for varying the lateral angle of the one side with respect to the given direction sufficient to vary the magnitude F of force to cause either movement of the floating island in a desired direction on the surface or maintenance of its stability with respect to the water.

Also known is U.S. Pat. No. 7,575,397 issued on Aug. 18, 2009 to Sergey Sharapov. This patent discloses a floating platform with a nonuniformly distributed load that is intended for supporting industrial, commercial, cultural, and dwelling structures and is suitable for deployment in shallow as well as in deep waters. The platform is assembled from prefabricated hollow structural elements in such a way that the unified center of load mass, which consists of a plurality of arbitrarily distributed loads of different masses supported by the platform, is always maintained in the same position, and the platform is always maintained in a horizontally counterbalanced position. This is achieved by locally adjusting the buoyancy of the structural elements. Furthermore, the loads are positioned on the platform so that movements created by these loads relative to the aforementioned unified center of masses are equal. This allows maintaining the loads on the platform in equilibrium.

An article published by Mostafa Shahrabi and Khosrow Bargi in *Frontiers of Structural and Civil Engineering, September* 2013, Volume 7, Issue 3, pp. 325-331 under the title "Numerical simulation of multibody floating piers to investigate pontoon stability" discloses a study aimed at developing a procedure to analyze the motion of a floating pier comprised of several pontoons that are modeled as rigid bodies and are connected by flexible and rigid connectors. Recently, the use of floating piers has increased because of their advantages, such as faster and higher-quality construction, seismic force isolation for a full-scale mooring system, low dependence on local soil conditions and tides, ability to relocate or reconfigure the pier modules during the operational period, and 75 to 100 years of repair-free service. A floating pier consists of a pier, access bridge, mooring system, and fender system, each of which comes in many variations to suit different uses and construction considerations. The typical loads used in the design of these piers are dead loads, live loads, mooring loads, fender loads, and environmental loads induced by wind, currents, and waves. For numerical simulation, three types of piers are used: passenger piers, light-cargo piers, and semiheavy-cargo piers. The selected piers consist of several large pontoons that are joined by pivots and that have a pile-based mooring system. These piers are modeled by SAP2000 software (Computers and Structures, Inc. (CSI), Walnut Creek, Calif.) as two-dimensional frames that are linked together. As the first step, each type of pier is subjected to loading, and its general behavior is assessed. According to this behavior, major load combinations are described for the design of the piers and are analyzed to determine behavior of the modules. Lastly, according to analysis results and safe use and stability considerations, such as maximum draft and longitudinal gradient, the dimensions of each module in each pier type are presented.

Also known in the art are various projects for living on water. One such project is described in detail in the publication by Wayne Gramlich in 1999 on Seasteading—Homesteading the High Seas (http://gramlich.net/projects/oceania/seastead2/#Gramlich1999 and the SeaSteading Institute Book of 2010 (http://www.seasteading.org/book/seasteading-book-beta/). These publications disclose various inhabited structures on water that rest on the bottom of the sea, ocean, or other water basins.

Furthermore, due to relative shortness of its flight provided by the Earth's rotation, a satellite launched from the equator will consume less fuel and thus will provide proportional cost savings. On the other hand, as compared with a launch, e.g., from Cape Canaveral, USA, a rocket fully loaded with fuel and launched from the equator can lift a load of approximately 30%.

In view of the above, it would be advantageous to provide a rocket-launching site on the equator. Such attempts have been made. For example, a project named "Sea Launch" was established in 1995 as a consortium of four companies from Norway, Russia, Ukraine and the United States, which was managed by Boeing with participation from other shareholders. The first rocket was launched in March 1999. All commercial payloads have been communications satellites intended for geostationary transfer orbit with customers such as EchoStar and DirecTV.

All factors listed above maintain a growing interest in various projects aimed at more effective use of vast areas occupied by the world's oceans.

SUMMARY OF THE INVENTION

A floating platform suggested by the present invention is a geographically stable platform intended for use on the surface of the ocean in areas with two undersurface counterflows. In the context of the present invention, the term "geographically stable platform" means a floating platform structure that is constantly located in the same geographical point on the surface of the Earth. The technique for controlling geographical stability of various moveable objects is known and is used on the basis of a global positioning system (GPS).

However, regarding a platform for launching rockets, e.g., for placing a satellite on a given orbit of movement around the Earth, the accuracy requirements of maintaining geographical stability of the launching platform are very high, e.g., tens of meters within several hours.

It should be noted that the invention relates not only to floating platforms for launching satellites but also, e.g., for geographical stabilization of other large vessels that may require long-term use in stabilized geographical positions for purposes other than launching rockets.

The present invention provides a floating platform structure on a surface of water in an area of an ocean having a first surface current that has a predetermined thickness and flow in a first direction and a second current located beneath the first current that has a predetermined thickness and flows in the direction opposite to the first direction. Such a condition occurs, e.g., in the equatorial area, e.g., of the Cromwell current zone. It should be noted that although the invention is exemplified below specifically for the Cromwell current zone, it equally applies to use in other similar equatorial currents.

More specifically, the floating platform structure comprises a floating barge that has a large flat surface area that may occupy, e.g., several square kilometers, and that has a deck for supporting various functional devices or structures, e.g., rocket-launching equipment, or the like. The structures of such barges or floating decks are known in the field of shipbuilding.

Rigidly attached to the barge or floating deck is a rigid three-dimensional frame that is submerged into water directly under the bottom of the barge. In the depth direction of water, this submerged frame passes through the first or upper oceanic water current and penetrates to the second or underneath oceanic counter-current to a substantial depth of the latter. Thus, the submerged frame length in ocean depth direction may reach 100 meters from the surface of water, and preferably should be in the range of 50 to 100 meters, and more preferably in the range of 50 to 70 m. The selected length in the depth direction is needed for placing the frame into both oceanic currents.

The submerged rigid frame comprises a part of a counter-flow system, which also contains an underwater sail device that is provided with at least first submerged floating bodies used for providing a sailing force under the effect of the second or underneath counter-current. The counter-flow system also comprises a mechanism for changing a resulting force of water currents acting on the first submerged floating bodies. Another essential part of the counter-flow system is a GPS-based control unit for maintaining the floating platform structure in a geographically stable condition on the surface of the water in response to changes that occur in the velocities and thickness of the water currents, etc.

The adjustment of the geographical position of the platform is carried out by changing vertical positions of the first floating bodies on the submerged frame within the boundaries of the second or underneath counter-current. This is achieved, e.g., by mounting the first floating bodies moveably on the frame elements and providing a drive force, e.g., from power winches installed on the deck or inside the barge structure.

The exact geographical position of the floating platform structure is constantly determined by GPS, which sends data to a CPU. The latter controls the operation of drivers that activate the winch motors.

According to one or several aspects of the invention, the floating platform structure may also contain second submerged floating bodies which are intended to increase floatability of the rigid frame since the latter may have a rather heavy weight, but in some cases the floatability of the rigid frame may be provided by the floating platform structure, itself.

DETAILED DESCRIPTION OF THE INVENTION

In the equatorial zone, the trade winds constantly blow in the westerly direction. For centuries the captains of sailing ships have been used the trade winds to cross the world's oceans. These winds generate water currents on the surface layers of the ocean. Such surface currents generate compensation flows which are located underneath these currents, and these surface currents have the same power but they flow in opposite directions in order to ensure stability of the ocean level in the equatorial zone. It is exactly this phenomenon that creates oceanic undersurface currents of the Cromwell type. Such a system of equatorial oceanic currents is a global scale phenomenon that spreads over vast areas of the world's oceans and may extend to more than 8000 miles long and to more than 300 miles wide. In the depth direction, the upper current has a thickness up to 50 meters, even up to 20 meters or less in some areas, with maximal velocity on the surface. The second, i.e., under current, has a thickness of approximately 200 meters and flows with maximal velocity at the depth of 70 to 100 meters. The velocity of the upper current on the surface of the water reaches 1.7 m/sec, and on the average is equal to 1.2 to 1.3 m/sec. Maximum velocity of the under current reaches 1.2 m/sec.

Although the equatorial oceanic currents are rather stable over long periods of time, still they are subject to some slow fluctuations with regard to flow velocities, thickness of flow layers, distribution of flow velocities in depth direction, etc. Short-time fluctuations occur during several hours and as a rule are 10% or less. Moreover, the currents are subject to seasonal fluctuations, which are also in the range of 10% or less.

The invention is based on using the aforementioned oceanic undersurface counter-flows for stabilization of large floating platform structures, e.g., satellite rocket launching platforms in order to maintain them in a predetermined geographical point of the Earth. Advantages of satellite rocket launching from the equator and the importance of geographic stability of the launching platforms are mentioned above.

However, in view of variability of a geographical position of the platform under effect of the aforementioned fluctuations of the undersurface current parameters in the equatorial oceanic zone, such floating platform structures must be provided with a mechanism for adjusting the sailing force and with a control system for maintaining the floating platform structure in a stable geographical point on the surface of the ocean.

Figure 1:
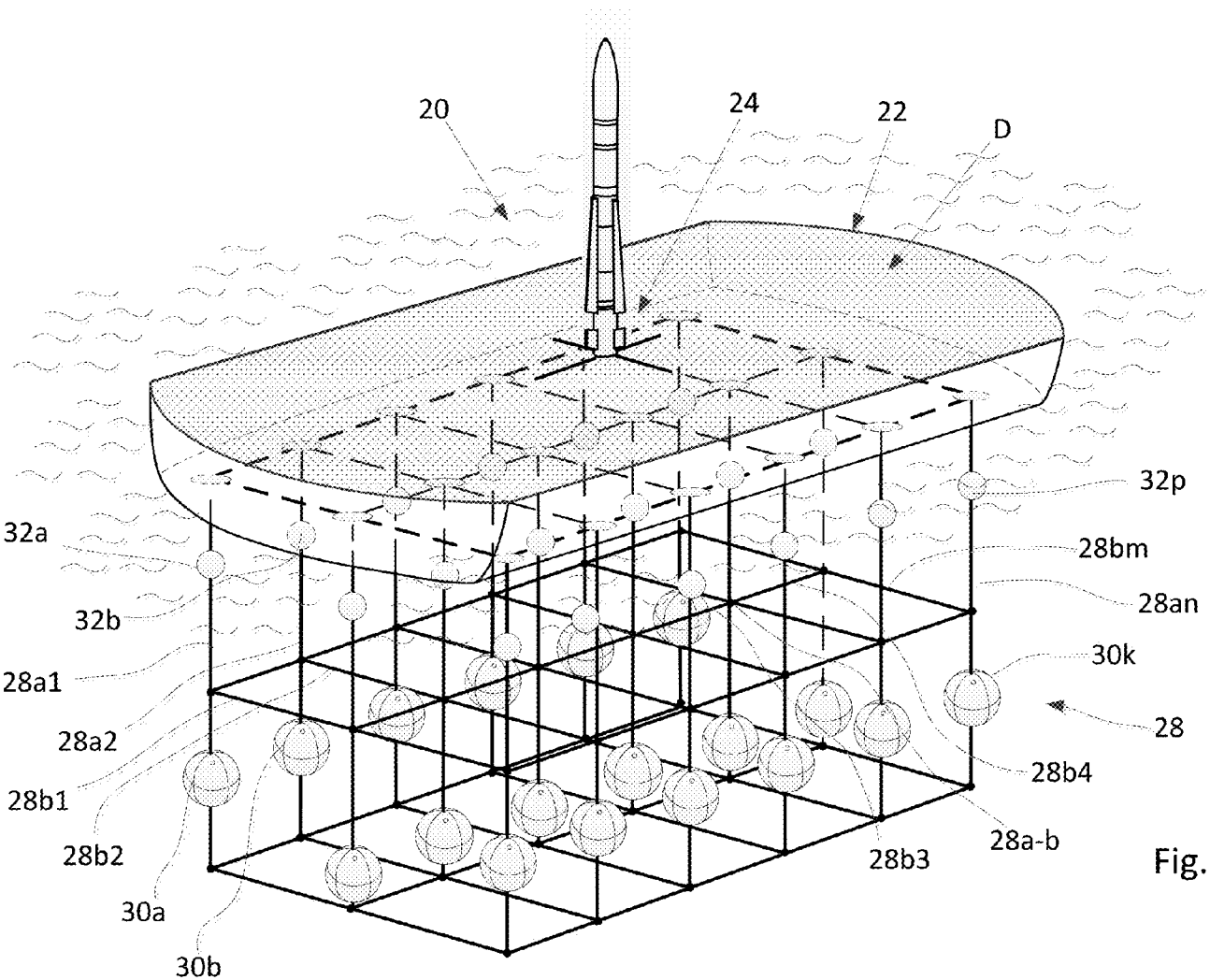
FIG. 1 is a schematic perspective view of the floating platform structure of the invention.

Shown in FIG. 1 is a three-dimensional view of the geographically stable floating platform structure based on the principle of the present invention.

In FIG. 1 the floating platform structure, as a whole, is designated by reference numeral 20. The supporting part of the floating platform structure 20 comprises a floating platform 22 that may support, e.g., launching equipment (start) 24, and has a deck D located above the level of the water W. The floating platform 22 may comprise a barge, raft, large vessel, etc., the surface area of which may be as large as several square kilometers.

Figure 2:
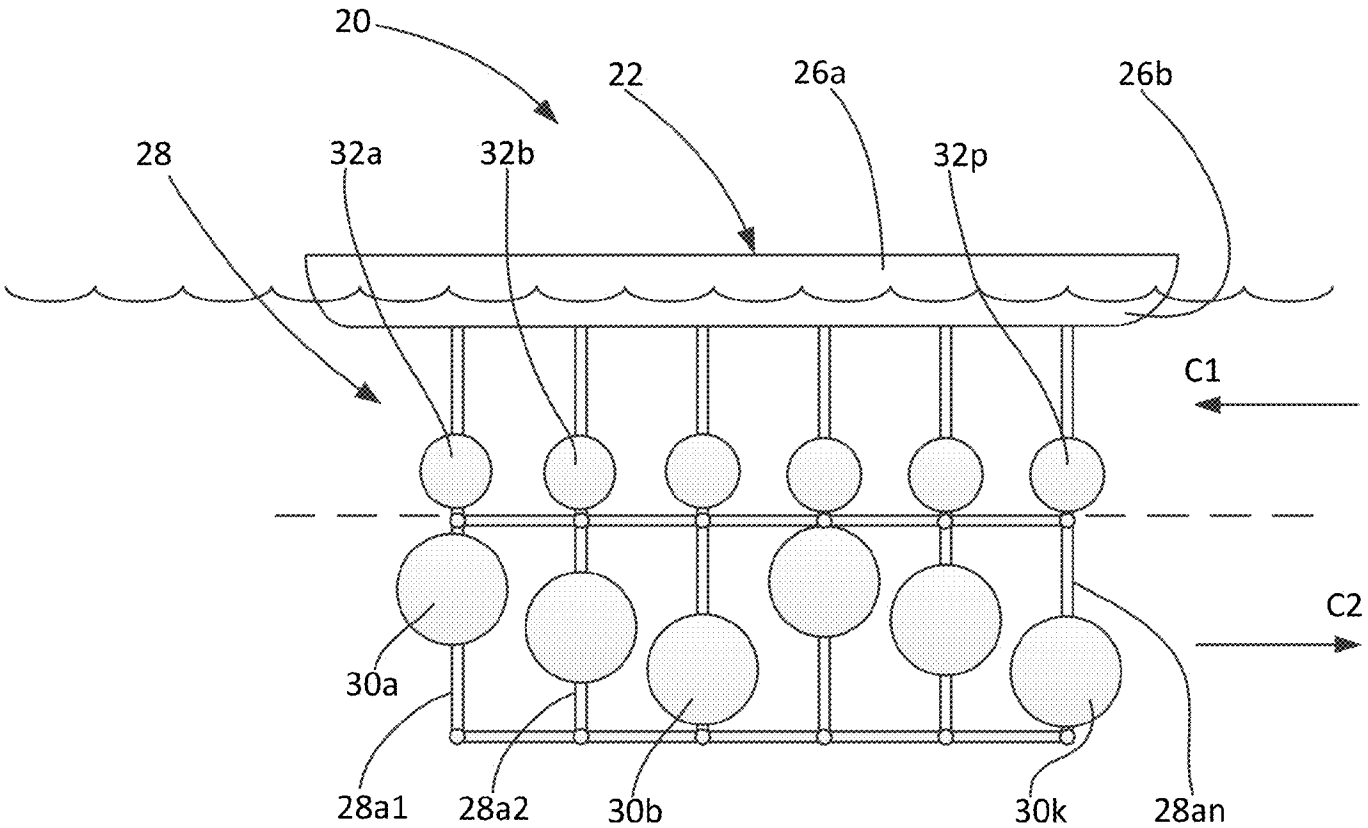
FIG. 2 is a schematic side view of the floating platform structure of FIG. 1.

As seen in FIG. 2, which is a schematic side view of the floating platform structure 20 in FIG. 1, the floating platform 22 has a nonsubmerged part 26*a*, which is located above the level of the water, and a submerged or underwater part 26*b*, which is submerged in water. Depending on the type of floating platform construction, the submerged part extends into the water to the depth of 15 meters or more.

The construction of such floating platforms is known and described in publications [see: (1) "Floating Ocean Platforms" by Dr. Ronald N. Kostoff, Office of Naval Research, 800 N. Quincy St., Arlington, Va. 22217; Internet: kostofr@onr.navy.mil); (2) "Floating Cities, Islands and States" by Alexander Bolonkin, C&R, 1310 Avenue R, No. F-6, Brooklyn, N.Y. 11229, USA; T/F 718-339-4563, aBolonkin@juno.com, http://Bolonkin.narod.ru).

As shown in FIGS. 1 and 2, the floating platform structure 20 is provided with a rigid three-dimensional frame 28. The frame 28 is attached to the floating platform 22 and is submerged into the water so that it passes through the upper current C1 (FIG. 2) and is immersed into the under counter-current C2.

The rigid three-dimensional frame 28 comprises vertical tubular elements 28*a*1, 28*a*2, . . . 28*an* and transverse elements 28*b*1, 28*b*2, . . . 28*bm*, which interconnect the vertical elements.

Figure 3:
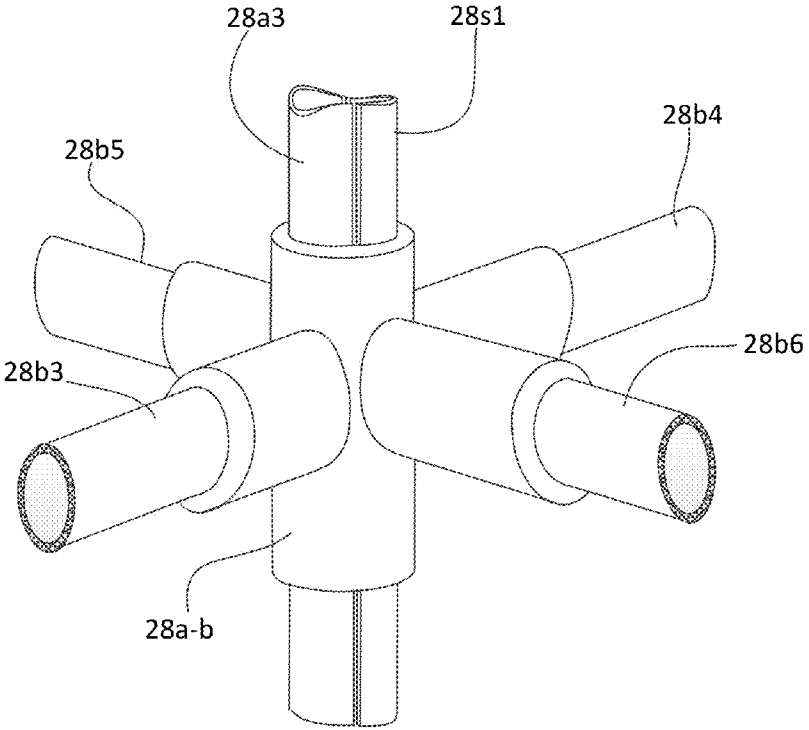
FIG. 3 is a three-dimensional view that illustrates an example of interconnection of horizontal and vertical tubular elements of the rigid three-dimensional frame of the invention.

An example of a simplest tube interconnection and fixation structure is shown in FIG. 3, which is a three-dimensional view. In this example, the frame elements comprise a plurality of tubes that may be interconnected, e.g., through the cross-type connector 28*a-b*. The interconnection structure shown in FIG. 3 is one located in the intermediate part of the frame 28 where the connector 28*a-b* interconnects five tubular elements, i.e., one vertical tubular element 28*a*3 and four horizontal tubular elements 28*b*3, 28*b*4, 28*b*5, and 28*b*6. It is understood that in the side positions of the frame 28, only two horizontal tubular elements are interconnected through a three-way connector. The tubular elements may be connected to the cross-type connector by welding, press fit, or the like. It is also understood that the shape and structure of the frame itself is given only as an example and that many other modifications are possible. For example, the frame may be preassembled from monolithic modular blocks and may be made from metal, plastic, plastic-coated plastic, etc.

The transverse tubular elements 28*b*3, 28*b*4, . . . impart rigidity to the entire three-dimensional frame 28, which is an important factor since the frame submerged into the counter-currents experience significant transverse loads. The main purpose of the vertical tubular elements 28*a*1, 28*a*2, . . . 28*an* is to support a plurality of submerged lower floating bodies 30*a*, 30*b*, . . . 30*k* that are located in the lower part of the frame 28 and are movably installed on the vertical tubular elements 28*a*1, 28*a*2, . . . 28*an* (upper floating bodies 32*a*, 32*b*, . . . 32*p*), which are shown in FIG. 1 and FIG. 2, are stationary and optional. They are needed as auxiliary elements for imparting additional buoyancy to the frame if buoyancy of the floating platform or barge 22 is insufficient to support the frame.

It is important to note that the vertical positions of the upper floating bodies and the lower floating bodies are selected so that when the frame is delivered to the zone of the Cromwell currents of the Pacific Ocean and the frame with the floating bodies is immersed into water, the upper floating bodies (if any) occur in the upper equatorial oceanic current C1 (FIG. 2), while the lower floating bodies occur in the lower oceanic current C2 that flows in the direction opposite the current C1.

As the submerged part 26*b* of floating platform or barge 22 has a very large surface area, it experiences very strong dragging force under effect of the viscous friction between the barge surface and water of the upper current C1. In order to counteract such forces and at the same time to maintain geographical stability of the barge in a predetermined point on the Earth's surface, the lower floating bodies 30*a*, 30*b*, . . . 30*k* are moveable on the vertical tubular elements 28*a*1, 28*a*2, . . . 28*an* in the vertical direction across the lower current C2. In other words, since the current C2 flows in the direction opposite to current C1, the lower floating bodies may be moved vertically to a position relative to a zero point (which is located on the boundary between the currents C1 and C2), in which the dragging force of the upper current is counterbalanced by the action of the forces applied to the lower floating bodies from the lower current. In order to facilitate vertical movements of the floating bodies, the buoyancy of these bodies slightly exceeds the Archimedes force acting on them. In other words, they have slightly negative buoyancy.

Figure 4:
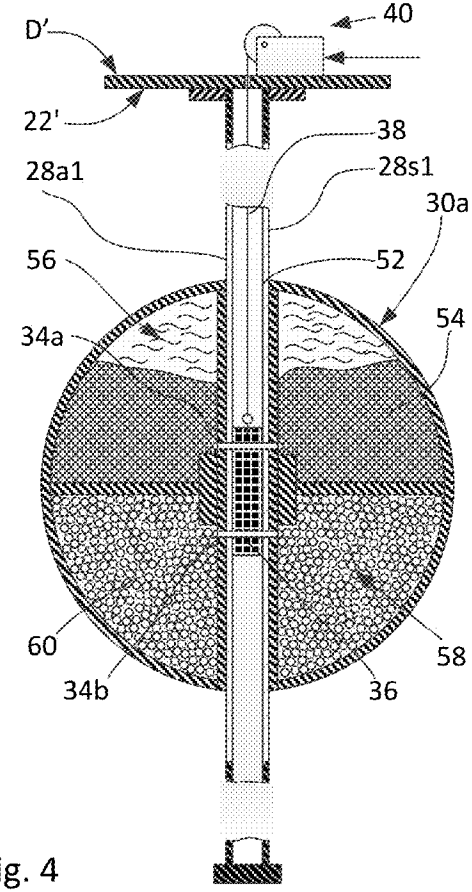
FIG. 4 is a side view illustrating an example of a mechanism of the invention suitable for vertical displacement of the floating bodies in the vertical direction.

An example of such a mechanism suitable for vertical displacement of the lower floating bodies 30*a*, 30*b*, . . . 30*k* is shown in FIG. 4. Although this mechanism is shown for a single floating body, e.g., the floating body 30*a*, it is understood that this mechanism may be provided for each floating body or for a group of interconnected floating bodies.

As seen in FIG. 4, which is a sectional view of the floating body 30*a* on a vertical tubular element 28*a*1, the latter has a through longitudinal slot 28*s*1 (FIG. 3 and FIG. 4) formed in the area of the lower current C2. This slot serves for guiding the ends of the pins 34*a* and 34*b*, which are secured in a slider that slides inside the interior of the tubular body. The slider 36 is connected to the lower end of a cable 38, the upper end of which is attached to a rotary drive mechanism, e.g., an electric winch 40 installed on the floating platform or barge 22.

Figure 5:
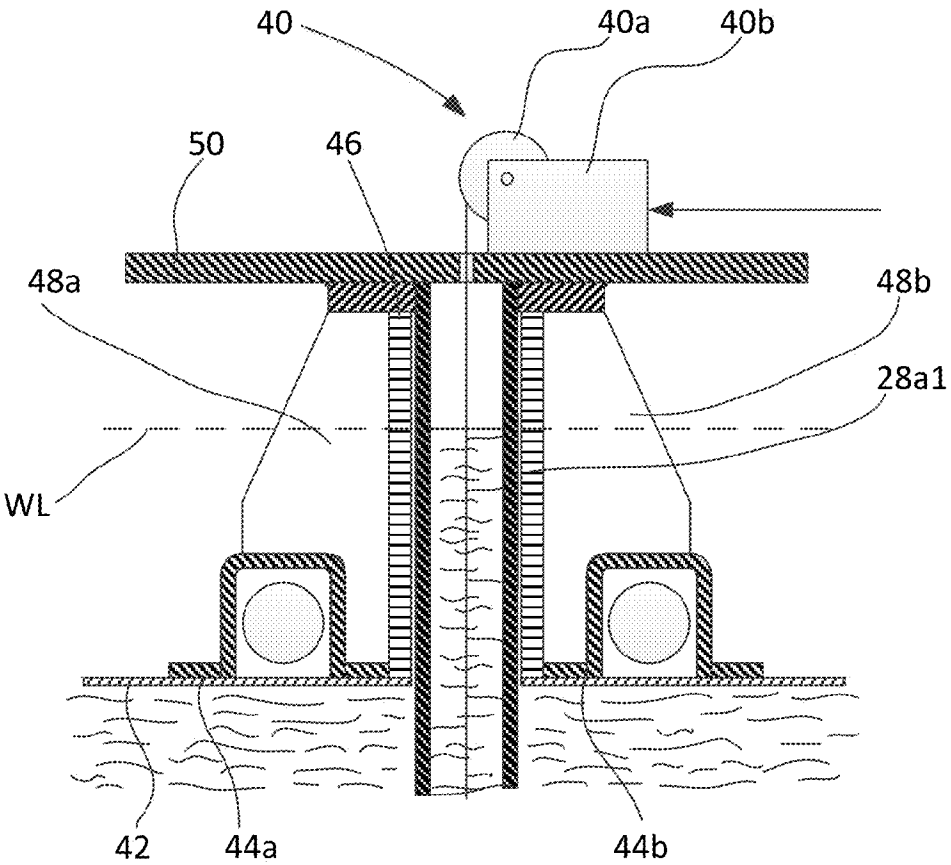
FIG. 5 is an example of attachment of the upper end of the vertical tubular element to the bottom of the barge hold.

An example of attachment of the upper end of the vertical tubular element 28*a*1 to the bottom of the barge hold 42 is shown in FIG. 5. Reference numerals 44*a* and 44*b* designate barge hull frames that support a tubular load-bearing element 46 that contains the vertical tubular element 28*a*1 and is attached, e.g., welded, to the barge-hull frames 44*a* and 44*b* and is reinforced by rigid ribs 48*a* and 48*b*. Attached to the upper end of the tubular load-bearing element 46 is a driver support plate 50 that supports the electric winch 40 that has a winding drum 40*a* and a drive motor 40*b* with a controller (not shown).

It is important to note that the lower end of the vertical tubular element 28*a*1 is open to water and located above the upper end thereof is the waterline WL (shown by a broken line in FIG. 5) with which the level of the water in the vertical tubular element coincides.

It is understood that the structure shown in FIG. 5 is one of many possible modifications and any other changes and variations are possible provided that they ensure sufficiently strong and reliable attachment of the vertical tubular element 28*a*1 to the barge or floating platform 22. It is also understood that vertical tubular elements may have a similar or different attachment to the hull of the barge or floating platform 22.

Figure 6:
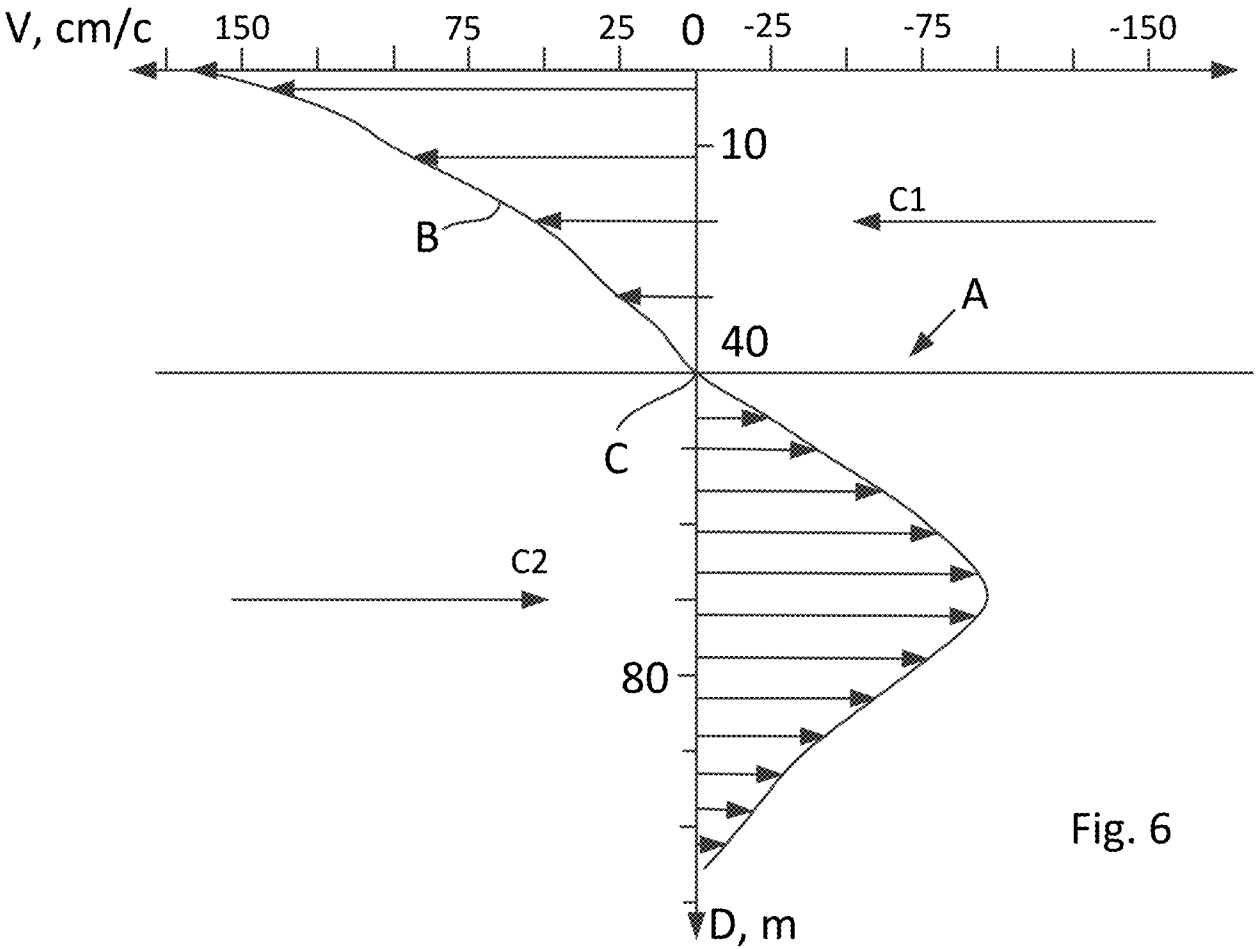
FIG. 6 is a diagram of water current forces under the floating platform structure in the equatorial part of the Pacific Ocean for which the platform of the invention is designed.

FIG. 6 is a diagram of water current forces under the floating platform structure in the equatorial part of the ocean, for which the platform of the invention is designed. In this drawing, C1 designates the upper equatorial current, and C2 designates the lower equatorial current, i.e., the aforementioned Cromwell current. This diagram shows distribution of the current velocity in the ocean depth direction. The upper horizontal line corresponds to the ocean surface, and the vertical line is oriented in the depth direction across the upper current C1 that flows from East to West and the lower countercurrent C2 flows in the opposite direction, which is shown by respective arrows. It is assumed that the lengths of the horizontal arrows that extend from the vertical line correspond to current velocities in respective layers of the currents C1 and C2. The horizontal direction velocities are shown in terms of cm/sec, and the depth of the ocean is shown in meters. In the plane of the drawing, point Con the horizontal line A (in reality, C is a line and A is a plane) is a zero-velocity point that is located on the boundary between the opposite currents. The diagram in FIG. 6 may correspond to real parameters of equatorial currents in a certain area of the Pacific Ocean and, as mentioned above, the velocities and thickness of the current layers may be subject to some temporal variations.

The design of the geographically stable floating platform structure of the present invention is based on the aforementioned Cromwell current phenomenon and in particular on the current velocity distribution shown in FIG. 6.

More specifically, in order to reach the layer of essential velocities in the lower current C2, the vertical geometrical dimension of the frame 28 should range from 50 m to 100 m, preferably 60 to 80 m. The transverse or horizontal dimensions of the frame 28 depend on the size of the floating platform 22 and may range, e.g., from 60 m to 300 m or more in both horizontal directions.

The floating platform or barge 22, itself, may have a length in the range, e.g., of 100 to 1000 m and a width in the range, e.g., of 60 to 400 m. The underwater part of the barge may be immersed into water to the depth of up to 50 m. In the latter case, it is not difficult to immerse the rigid three-dimensional frame 28 to a depth of 100 or more meters from the surface of the ocean. As a result, the floating bodies 30*a*, 30*b*, . . . 30*k* can be placed into the high-velocity layer of the lower current C2. In any case, the structure of the frame 28 and its position in water must ensure placement of the floating bodies in the zone of the lower current, the velocity of which provides counteraction against the action of the dragging force developed by the upper current C1.

Figure 7A:
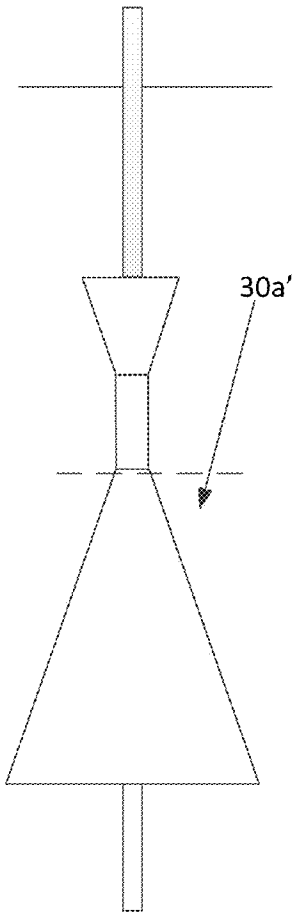
FIG. 7 shows various shapes of the floating bodies of the invention, wherein FIG. 7(*a*) illustrates an hourglass shape, FIG. 7(*b*) shows a cylindrical floating body, and 7(*c*) shows a spherical floating body.
Figure 7B:
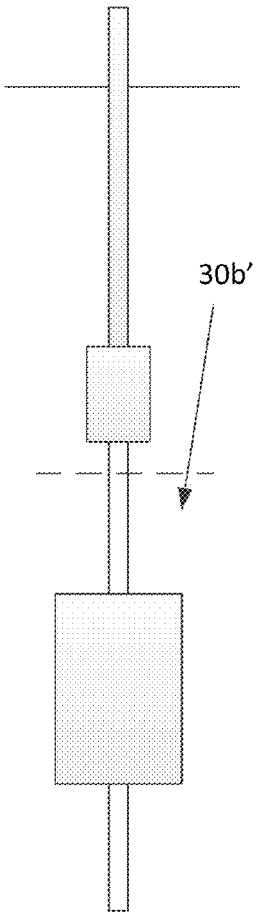
Figure 7C:
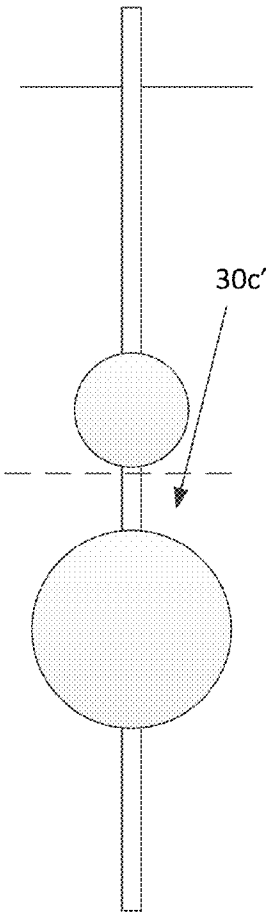

It is known that the dragging force developed under the effect of viscous friction of liquid on the surface of a body immersed into a laminar flow of this liquid is approximately proportional to the area of the body washed with the liquid and to the velocity of the current. Thus, the product of an average velocity of the current C2 by the surface area of the floating body in the zone where this body is washed with water should be approximately equal to the product of the velocity of the current C1 by the surface area of the underwater part of the floating platform or barge 22. In other words, if the given parameters of the barge, its buoyancy, shape, and surface area of the underwater part 26*b* (FIG. 2) are known, it is possible to calculate the sizes and positions of the floating bodies 30*a*, 30*b*, . . . 30*a*. Regarding the shape of the floating bodies, they may have different configurations, examples of which are shown in FIG. 7, where FIG. 7(*a*) shows floating bodies 30*a*' having an hourglass shape, FIG. 7(*b*) shows cylindrical floating bodies 30*b*', and FIG. 7(*c*) shows spherical floating bodies 30*c*'. The spherical floating bodies 30*c*' are most advantageous from the technological point of view.

Calculations show that the spherical bodies 30*c* may have a diameter, e.g., in the range of 2 m to 5 m. The floating bodies are hollow, may be molded, e.g., from a high-density polyethylene, and should have an interior structure of the type shown in FIG. 4. As seen in this drawing, the floating body has a through central hole 52 for guiding the floating body along the vertical tubular body. The latter has an inner diameter that provides free siding of the slider 36. In other words, the slider 36 that is moveably installed inside the vertical tubular element 28*a*1 of the rigid three-dimensional frame 28 that supports the first floating body 30*a*, the cable 38 that connects the slider to the drive mechanism 40, the through hole 52 formed in the floating body 30*a* for guiding thereof along the vertical tubular element 28*a*1, the vertical slot 28S1 formed in the vertical tubular element 28*a*1, and the pin 34*a* that connects the slider 36 with the floating body and is guided in the vertical slot 28S1 of the vertical tubular element form vertical guide means for vertical movement of the floating body.

As shown in FIG. 4, the interior of the floating body 30*a* is separated into two parts. One part (in this case, the upper part 56) of the interior of the floating body is filled with foam plastic 54, which imparts buoyancy to the floating body. This buoyancy is compensated to a required value by filling the other part 58 of the body interior with a ballast 60, e.g., mixture of sand and water. The ballast section should be sealed against washing out the ballast. Each lower floating body 30*a*, 30*b*, . . . 30*k* may slide along the vertical tubular elements, such as the tubular element 28*a*1 under force of the winch 40 and its own gravity.

To launch a satellite, the geographically stable floating platform structure is delivered to a required geographical point of the Earth, e.g., to the area Cromwell equatorial current in the Pacific Ocean from where launching of the satellite-carrying rockets is advantageous from the viewpoint of the payload to be delivered to the Earth orbit.

The aforementioned geographical point of the ocean is characterized by known velocities of the upper and lower currents, as well as the thickness of the current layers. In other words, the distribution of water current velocities (FIG. 6) and the zero-velocity point are known. The geometrical and weight characteristics of the barge 22, of frame 28, and floating bodies 30*a*, 30*b*, . . . 30*k* are known as well.

All equipment for launching, as well as the submerged rigid frame 28 with the floating bodies, is loaded on the barge 22 for delivery in assembly-ready conditions.

Upon delivery to the required geographical point, the launching equipment is installed and the underwater part of the geographically stable floating platform structure 20 is assembled and attached to the barge on its surface and under water by divers. The weight of the structure itself is alleviated by the buoyancy of the barge and the floating bodies. The underwater assembling operations, such as installation and attachment of the heavy frame 28, are also alleviated by rationally using buoyancy of the respective parts.

In other words, the floating bodies 30*a*, 30*b*, . . . 30*k* are installed in appropriate precalculated vertical positions on the tubular elements 28*a*1, 28*a*2, . . . 28*an*. In these positions, the floating bodies experience the forces applied from the current C2 that counter-balances the dragging force acting on the barge 22 from the upper current C1 that is trying to drag the barge in the direction opposite to the current C2.

After preliminary positioning of the floating platform structure 20 in the appointed geographical location, fine adjustment of the geographical position of the structure 20 is carried out by means of GPS (FIG. 1). The signals obtained from the GPS may provide an actual position of the barge, with accuracy of about several meters. The signals obtained from the GPS are used manually or automatically for correction of the barge position on the surface of the Earth. The data obtained from the GPS are used for activation of the controller that controls operation of the electric winch 40.

In other words, the GPS locates an actual geographical position of the floating platform structure 20 and generates data for correcting the deviations of the floating platform structure 20 from the given geographical point caused by the upper current C1. This is done by activating the drive mechanisms 40 and moving the floating bodies 30*a*, 30*b*, . . . 30*k* to positions that stabilize the geographical position of the floating platform structure by using the forces applied to the surfaces of the floating bodies from the second current C2.

Depending on a required action, the winch ether pulls the respective floating body, e.g., the floating body 30*a*, up by winding the cable 38 on the drum, or by releasing the cable to let the floating body descend under its own gravity to a required depth from the ocean level. It is understood that several winches like the winch 40 (FIG. 4) are installed on the floating deck for controlling vertical movements of individual or grouped floating bodies. Only one such which, however, is shown in the drawing for simplicity.

The moment that is created by a force pair generated by currents flowing in opposite direction may be counterbalanced with the use of a method described in U.S. Pat. No. 7,575,397 of the same applicant, wherein such a balance is achieved by nonuniform distribution of loads on the barge.

Although the invention is shown and described with reference to specific examples, it is understood that these examples should not be construed as limiting the areas of application of the invention and that any changes and modifications are possible provided that these changes and modifications do not depart from the scope of the attached patent claims. For example, the floating platform structure may be different from the one shown and described herein and may be assembled, e.g., from a plurality of individual frameworks. The frame 28 may have a construction different from the one shown and may be monolithic. The floating platform structure is not a rocket-launching floating structure but may comprise a floating resort, floating island with housings and infrastructure for dwelling, an oil-drilling platform, a floating airport, etc.

I claim:

1. A floating platform structure for use on a surface of water in an area of an ocean having a first current having a predetermined thickness in an ocean depth direction and flowing in a first direction and a second current located underneath the first current that has a predetermined thickness in the ocean depth direction and flows opposite to the direction of the first current, the floating platform structure comprising:

a floating platform having a nonsubmerged part, which is located above the surface of water, and a submerged part located below the surface of water;

a rigid three-dimensional frame attached to the floating platform and having a vertical length in the direction perpendicular to the surface of water sufficient to pass through the first current into the second current when immersed in the water;

vertical guide means for guiding first floating bodies in the vertical direction, the vertical guide means being installed on the rigid three-dimensional frame;

at least the first floating bodies which are installed on the rigid three-dimensional frame moveably in the vertical direction on the vertical guide means and within the second current when the floating platform structure is delivered to the area of the ocean having the first and the second current; and drive mechanisms installed on the floating structure and connected to the floating bodies for moving the floating bodies in the vertical direction of the rigid three-dimensional frame on the vertical guide means.

2. The structure of claim 1, further comprising a global positioning system for locating an actual geographical position of the floating platform structure and for generating data for correcting deviations in the floating platform structure from the given geographical point by activating the drive mechanisms and moving the first floating bodies to positions that stabilize the geographical position of the floating platform structure by using forces applied to the floating bodies from the second current.

3. The structure of claim 1, wherein the shape of the floating bodies is selected from the group consisting of a spherical shape, an hourglass shape, and a cylindrical shape.

4. The structure of claim 2, wherein the shape of the floating bodies is selected from the group consisting of a spherical shape, an hourglass shape, and a cylindrical shape.

5. The structure of claim 1, wherein the vertical guide means for a floating body comprise a slider that is moveably installed inside a vertical tubular element of the rigid three-dimensional frame which supports a first floating body, a cable that connects the slider to the drive mechanism, a through hole formed in the floating body for guiding thereof along the vertical tubular body, a vertical slot formed in the vertical tubular element, and a pin that connects the slider with the first floating body and is guided in the vertical slot of the vertical tubular element.

6. The structure of claim 2, wherein the vertical guide means for a floating body comprise a slider that is moveably installed inside a vertical tubular element of the rigid three-dimensional frame which supports a first floating body, a cable that connects the slider to the drive mechanism, a through hole formed in the floating body for guiding thereof along the vertical tubular body, a vertical slot formed in the vertical tubular element, and a pin that connects the slider with the first floating body and is guided in the vertical slot of the vertical tubular element.

7. The structure of claim 3, wherein the vertical guide means for a floating body comprise a slider that is moveably installed inside a vertical tubular element of the rigid three-dimensional frame which supports a first floating body, a cable that connects the slider to the drive mechanism, a through hole formed in the floating body for guiding thereof along the vertical tubular body, a vertical slot formed in the vertical tubular element, and a pin that connects the slider with the first floating body and is guided in the vertical slot of the vertical tubular element.

8. The structure of claim 1, wherein the floating body is hollow and has an interior that is separated into two parts, one of which is filled with a foam plastic for imparting buoyancy to the floating body, and the other part of which is filled with a ballast for adjusting the buoyancy to a required level.

9. The structure of claim 2, wherein the floating body is hollow and has an interior that is separated into two parts, one of which is filled with a foam plastic for imparting buoyancy to the floating body, and the other part of which is filled with a ballast for adjusting the buoyancy to a required level.

10. The structure of claim 7, wherein the floating body is hollow and has an interior that is separated into two parts, one of which is filled with a foam plastic for imparting buoyancy to the floating body, the other part of which is filled with a ballast for adjusting the buoyancy to a required level.

11. The structure of claim 1, wherein the vertical length of the rigid three-dimensional body from the level of water ranges from 50 to 100 meters.

12. The structure of claim 2, wherein the vertical length of the rigid three-dimensional body from the level of water ranges from 50 to 100 meters.

13. The structure of claim 3, wherein the vertical length of the rigid three-dimensional body from the level of water ranges from 50 to 100 meters.

14. The structure of claim 1, wherein the second current is the Cromwell equatorial current of the Pacific Ocean.

15. The structure of claim 2, wherein the second current is the Cromwell equatorial current of the Pacific Ocean.

16. The structure of claim 3, wherein the second current is the Cromwell equatorial current of the Pacific Ocean.

17. The structure of claim 8, wherein the second current is the Cromwell equatorial current of the Pacific Ocean.

18. The structure of claim 1, further comprising second floating bodies attached to the upper part of the rigid three-dimensional frame for location in the upper current and for imparting additional buoyancy to the rigid three-dimensional frame if the buoyancy of the floating platform is insufficient for supporting the rigid three-dimensional frame in a floating state.

19. The structure of claim 2, further comprising second floating bodies attached to the upper part of the rigid three-dimensional frame for location in the upper current and for imparting additional buoyancy to the rigid three-dimensional frame if the buoyancy of the floating platform is insufficient for supporting the rigid three-dimensional frame in a floating state.

20. The structure of claim 3, further comprising second floating bodies attached to the upper part of the rigid three-dimensional frame for location in the upper current and for imparting additional buoyancy to the rigid three-dimensional frame if the buoyancy of the floating platform is insufficient for supporting the rigid three-dimensional frame in a floating state.

21. The structure of claim 7, further comprising second floating bodies attached to the upper part of the rigid three-dimensional frame for location in the upper current and for imparting additional buoyancy to the rigid three-dimensional frame if the buoyancy of the floating platform is insufficient for supporting the rigid three-dimensional frame in a floating state.

* * * * *